US007752689B1

(12) United States Patent
Shamie et al.

(10) Patent No.: US 7,752,689 B1
(45) Date of Patent: Jul. 13, 2010

(54) CRIB WITH PIVOTING AND SLIDING DROP SIDE RAIL

(75) Inventors: Sam I. Shamie, Brooklyn, NY (US); Francisco J. Reyes, Brooklyn, NY (US)

(73) Assignee: Delta Enterprise Corp., New York, NY (US)

( * ) Notice: Subject to any disclaimer, the term of this patent is extended or adjusted under 35 U.S.C. 154(b) by 45 days.

(21) Appl. No.: 12/330,562

(22) Filed: Dec. 9, 2008

(51) Int. Cl.
*A47D 7/02* (2006.01)

(52) U.S. Cl. ..... 5/100; 5/93.1

(58) Field of Classification Search ..... 5/93.1, 5/100, 425, 428–430
See application file for complete search history.

(56) References Cited

U.S. PATENT DOCUMENTS

| | | | | | |
|---|---|---|---|---|---|
| 1,678,237 | A | | 7/1928 | Vallone | |
| 1,695,571 | A | | 12/1928 | Baxter | |
| 2,289,132 | A | | 7/1942 | Lehman et al | |
| 2,679,055 | A | | 5/1954 | John et al | |
| 3,002,199 | A | * | 10/1961 | Galloway | 5/100 |
| 3,100,899 | A | * | 8/1963 | Wright | 5/430 |
| 3,506,989 | A | * | 4/1970 | Knight et al. | 5/430 |
| 3,896,513 | A | * | 7/1975 | Boucher et al. | 5/99.1 |
| 3,930,272 | A | * | 1/1976 | Boudreau | 5/11 |
| 4,706,312 | A | | 11/1987 | Shamie | |
| 4,715,075 | A | | 12/1987 | Shamie | |
| 5,926,870 | A | | 7/1999 | Branca-Barnes et al. | |
| 6,167,580 | B1 | | 1/2001 | Draheim | |
| 6,175,974 | B1 | | 1/2001 | Draheim | |
| 6,571,409 | B2 | | 6/2003 | Guillot | |
| 6,611,976 | B2 | | 9/2003 | Guillot | |
| 6,922,858 | B1 | | 8/2005 | Shamie | |
| 7,415,740 | B1 | * | 8/2008 | Kemper | 5/424 |

* cited by examiner

*Primary Examiner*—Michael Trettel
(74) *Attorney, Agent, or Firm*—Richard M. Goldberg

(57) ABSTRACT

A connecting arrangement for slidably securing a drop side rail to vertical posts of the headboard and footboard of a crib, including first and second elongated slots in the vertical posts of the headboard and footboard, respectively, third and fourth elongated slots at opposite sides of the drop side rail, first and second levers having one end pivotally mounted to opposite sides of the drop side rail and an opposite end slidably mounted with the first and second elongated slots, respectively, third and fourth levers having one end pivotally mounted to the vertical post of the headboard and footboard, respectively, and an opposite end slidably mounted with the third and fourth elongated slots, respectively, and a holding arrangement for releasably holding the drop side rail in an upper raised position.

18 Claims, 12 Drawing Sheets

CRIB WITH PIVOTING AND SLIDING DROP SIDE RAIL

BACKGROUND OF THE INVENTION

The present invention relates generally to infant cribs, and more particularly, is directed to a drop side rail for a crib.

Generally, in cribs, one side rail is fixed or stationary, and the opposite side rail can be slid vertically between an upper closed position and a lower open position to aid in the removal of the child from the crib or for placing the child in the crib. However, recently, because of incorrect assembly of the drop side rail by some consumers, children have been able to partially separate or disassemble the drop side rail from the main body of the crib, resulting in a body part of a child getting caught therebetween, causing injury to the child. For this reason, and because of various government proposed regulations, at a recent industry convention, it was proposed to make both side rails permanent and eliminate the drop side nature of one side entirely.

This, however, makes it much more difficult to remove the child from the crib or place the child in the crib, and has been deemed unsatisfactory.

SUMMARY OF THE INVENTION

Accordingly, it is an object of the present invention to provide a crib with a drop side rail that overcomes the aforementioned problems.

It is another object of the present invention to provide a crib with a drop side rail that is both pivotally and slidably lowered.

It is still another object of the present invention to provide a crib with a drop side rail in which only an upper rail section of the side rail can be lowered, and in which the lower rail section is stationary.

It is yet another object of the present invention to provide a crib with a drop side rail having an upper rail section that slides relative to a lower rail section and is connected via levers so that the upper rail section slides in parallel relation to and in front of the lower rail section.

In accordance with an aspect of the present invention, a connecting arrangement for slidably securing a drop side rail of a crib to respective vertical posts of the headboard and footboard of the crib. The connecting arrangement includes a first elongated guide in a vertical post of the headboard, and a second elongated guide in a vertical post of the footboard. A first lever has one end pivotally mounted to the drop side rail and an opposite end slidably mounted with the first elongated guide, and a second lever has one end pivotally mounted to the drop side rail and an opposite end slidably mounted with the second elongated guide. A holding arrangement releasably holds the drop side rail in an upper raised position.

The drop side rail includes a stationary lower side rail section fixedly mounted to respective vertical posts of the headboard and footboard of the crib, and an upper side rail section that is movable relative to the stationary lower side rail section, for movement between a raised position above and substantially coplanar with the lower side rail section and a lowered position in front of the lower side rail section, wherein the one end of the first and second levers are pivotally mounted to the upper rail section of the drop side rail.

The connecting arrangement further includes a third elongated guide at one side of the drop side rail, a fourth elongated guide at an opposite side of the drop side rail, a third lever having one end pivotally mounted to the vertical post of the headboard and an opposite end slidably mounted with the third elongated guide, and a fourth lever having one end pivotally mounted to the vertical post of the footboard and an opposite end slidably mounted with the fourth elongated guide.

Each elongated guide includes an elongated slot and the opposite end of each lever includes a pin slidably mounted in a respective the slot.

Further, the first lever is vertically movable relative to the third lever, and the second lever is vertically movable relative to the fourth lever. In this regard, the first lever is positioned above the third lever, and the second lever is positioned above the fourth lever.

The one end of the first lever is pivotally mounted to the drop side rail at a position above the third elongated guide, and the one end of the second lever is pivotally mounted to the drop side rail at a position above the fourth elongated guide. Also, the one end of the third lever is pivotally mounted to the vertical post of the headboard at a position below the first elongated guide, and the one end of the fourth lever is pivotally mounted to the vertical post of the footboard at a position below the second elongated guide.

The holding arrangement preferably includes a blind opening in the vertical post of at least one of the headboard and the footboard, and a post secured to the opposite end of at least one of the first and second levers for engaging in the blind opening in the vertical post of the at least one of the headboard and the footboard, to releasably hold the drop side rail in an upper raised position.

In accordance with another aspect of the present invention, crib is provided having the aforementioned connecting arrangement. Specifically, the crib includes a headboard having a pair of spaced apart vertical posts; a footboard having a pair of spaced apart vertical posts; a mattress support for supporting a mattress between the headboard and footboard; a first side rail secured to respective vertical posts of the headboard and footboard on one side of the crib; a drop side rail; and the aforementioned connecting arrangement for slidably securing the drop side rail to respective vertical posts of the headboard and footboard on an opposite side of the crib, the connecting arrangement including a first elongated guide in a vertical post of the headboard, a second elongated guide in a vertical post of the footboard, a first lever having one end pivotally mounted to the drop side rail and an opposite end slidably mounted with the first elongated guide, a second lever having one end pivotally mounted to the drop side rail and an opposite end slidably mounted with the second elongated guide, and a holding arrangement for releasably holding the drop side rail in an upper raised position.

The above and other objects, features and advantages of the invention will become readily apparent from the following detailed description thereof which is to be read in connection with the accompanying drawings.

DETAILED DESCRIPTION

Figure 1:
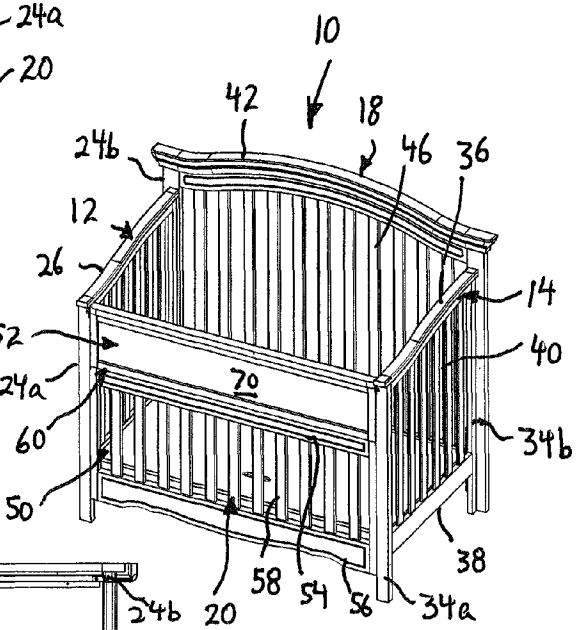
FIG. 1 is a front perspective view of the crib according to the present invention, with the upper rail section of the drop side rail in a raised position.

The present invention provides a different arrangement for the drop side rail so that only the upper rail section of the drop side rail is slid down relative to the lower rail section thereof.

Referring to the drawings in detail, and initially to FIGS. 1-5 thereof, a crib 10 according to the present invention includes a headboard 12 and a footboard 14 connected together in a parallel, spaced apart relation to each other. A first side of crib 10 is closed by a stationary rail 18, while the opposite side is closed by a partial drop side rail 20, the upper portion of which can be lowered or raised, as will be described in greater detail hereafter.

Preferably, headboard 12 and footboard 14 are connected together only by stationary rail 18 and partial drop side rail 20. Hooks or the like (not shown), as are well known, can extend from headboard 12 and footboard 14, for supporting a mattress support 22 that can include, but is not limited to, a mattress board, a slat assembly, a steel spring deck, etc.

Alternatively, as shown in the figures, headboard 12 and footboard 14 are connected together at lower positions thereat by two parallel, spaced apart stabilizer bars 16. Stabilizer bars 16 can be connected to headboard 12 and footboard 14 in any suitable manner such as screws or the like. Stabilizer bars 16 may be connected in accordance with the teachings in U.S. Pat. No. 4,639,956, issued Feb. 3, 1987, the entire disclosure or which is incorporated herein by reference. In such case, mattress support 22 is supported by stabilizer bars 16 for supporting a mattress (not shown) thereon.

Figure 3:
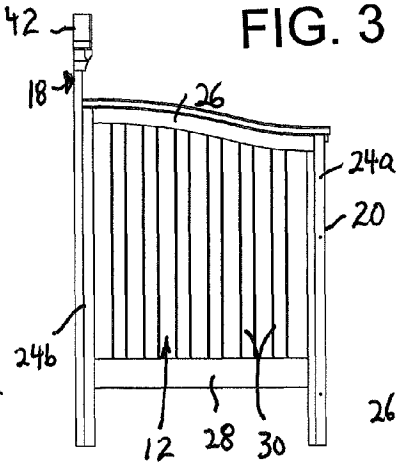
FIG. 3 is a left side elevational view of the crib of FIG. 1.
Figure 4:
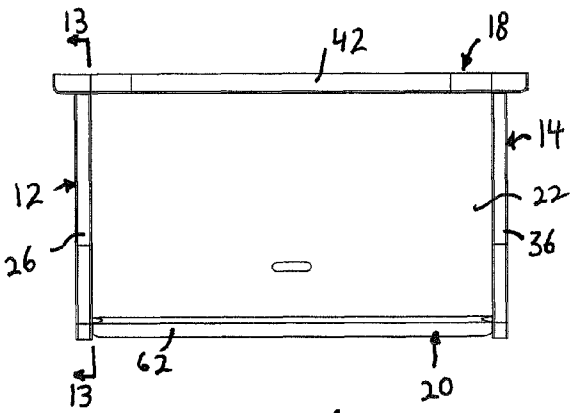
FIG. 4 is a top plan view of the crib of FIG. 1.

As shown best in FIGS. 1 and 3, headboard 12 is formed by two parallel, spaced apart posts 24*a* and 24*b* which form corner posts for crib 10. Posts 24*a* and 24*b* are connected at their upper ends by a horizontally oriented upper cross brace 26 and are connected at positions approximately one-quarter of the length thereof measured from the lower ends by a horizontally oriented lower cross brace 28. A plurality of equidistantly spaced apart vertical slats or rods 30 interconnect upper cross brace 26 and lower cross brace 28.

In like manner, as shown in FIG. 1, footboard 14 is formed by two parallel, spaced apart posts 34*a* and 34*b* which form corner posts for crib 10. Posts 34*a* and 34*b* are connected at their upper ends by a horizontally oriented upper cross brace 36 and are connected at positions approximately one-quarter of the length thereof measured from the lower ends by a horizontally oriented lower cross brace 38. A plurality of equidistantly spaced apart vertical slats or rods 40 interconnect upper cross brace 36 and lower cross brace 38.

During assembly, headboard 12 and footboard 14 are first assembled with two stabilizer bars 16 on opposite sides of crib 10, for example, according to the teachings of U.S. Pat. No. 4,639,956. Each stabilizer bar 16 is formed by an elongated, rectangular parallelepiped shaped bar having an inwardly directed ledge spaced slightly down from the upper end thereof for supporting mattress board 22 thereon. Each ledge preferably extends the length of the bar, but can be made shorter in length than each respective rectangular parallelepiped shaped bar. As is well known, mattress board locks (not shown) in the form of a flat, generally triangular shape can be pivotally mounted to the upper surface of the rectangular parallelepiped shaped bar by screws. In this manner, when mattress board 22 is supported on the ledges, the locks can be pivoted inwardly to lock mattress board 22 in place.

Figure 2:
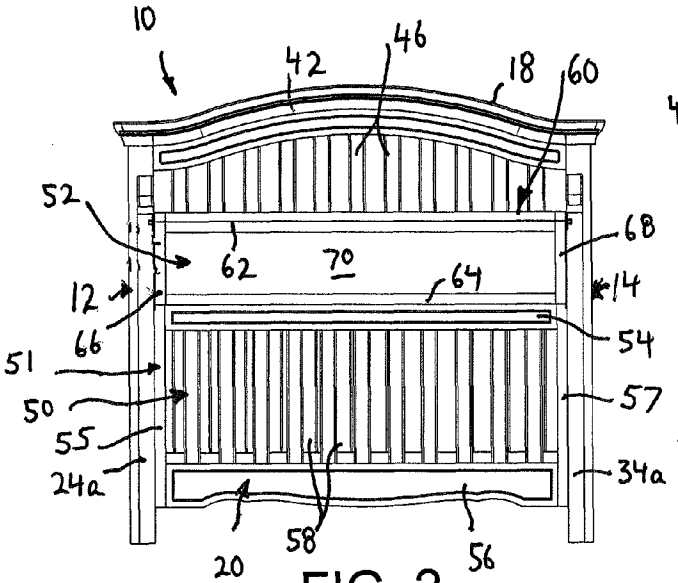
FIG. 2 is a front elevational view of the crib of FIG. 1.
Figure 5:
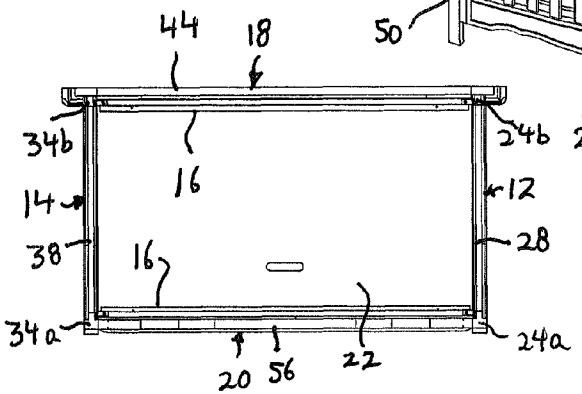
FIG. 5 is a bottom plan view of the crib of FIG. 1.
Figure 6:
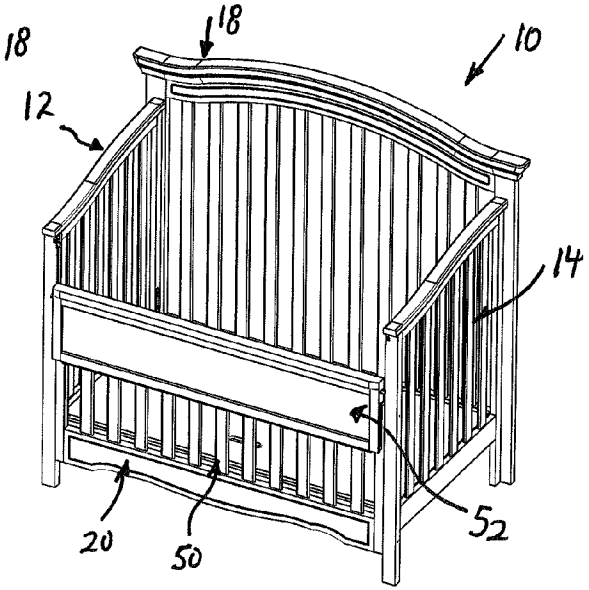
FIG. 6 is a front perspective view of the crib according to the present invention, with the upper rail section of the drop side rail in a lowered position.
Figure 8:
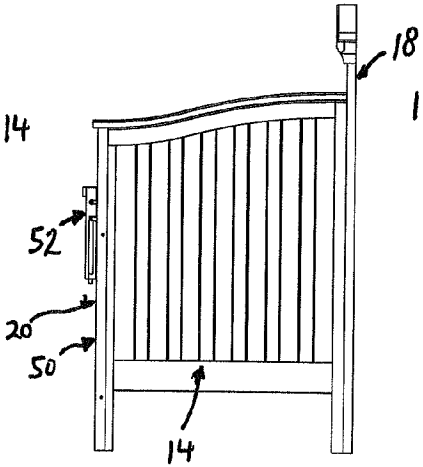
FIG. 8 is a right side elevational view of the crib of FIG. 6.
Figure 7:
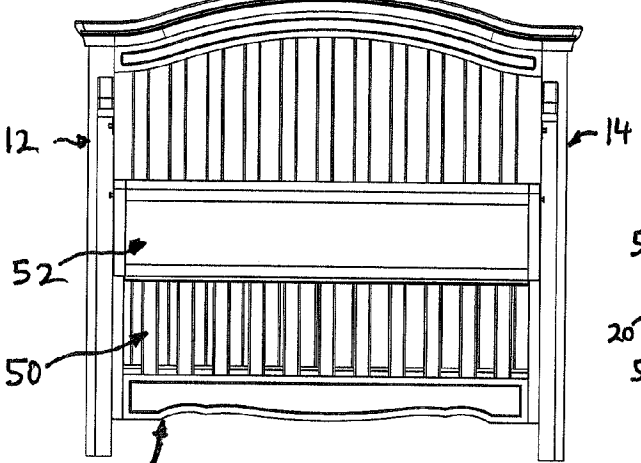
FIG. 7 is a front elevational view of the crib of FIG. 6.
Figure 10:
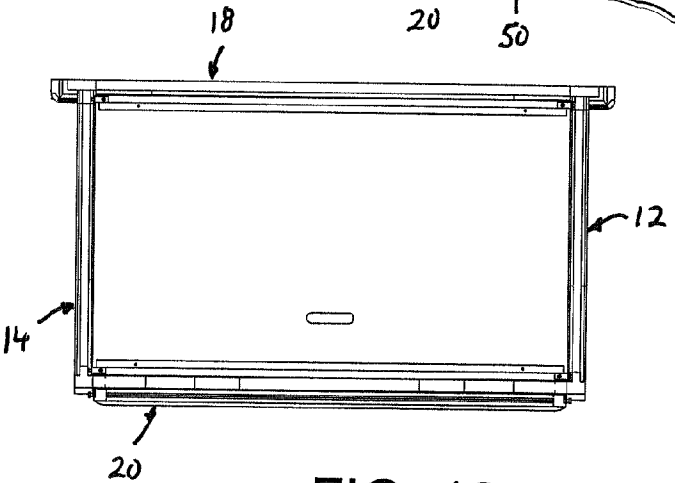
FIG. 10 is a bottom plan view of the crib of FIG. 6.
Figure 9:
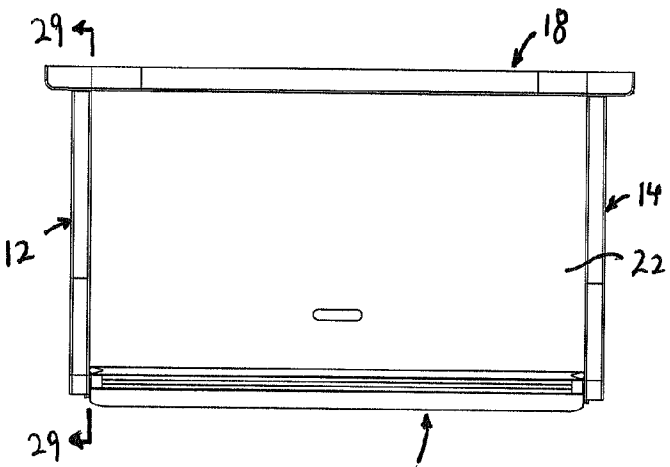
FIG. 9 is a top plan view of the crib of FIG. 6.
Figure 11:
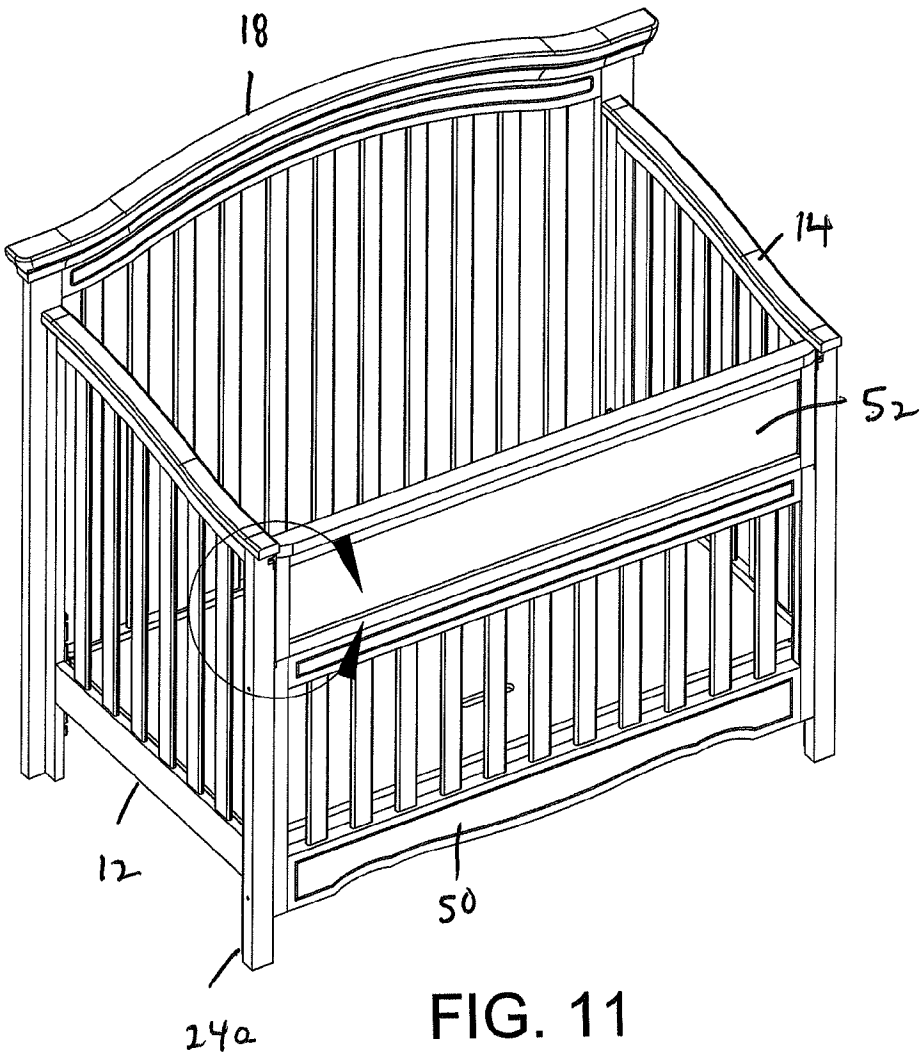
FIG. 11 is a front perspective view of the crib according to the present invention, with the upper rail section of the drop side rail in a raised position.
Figure 12:
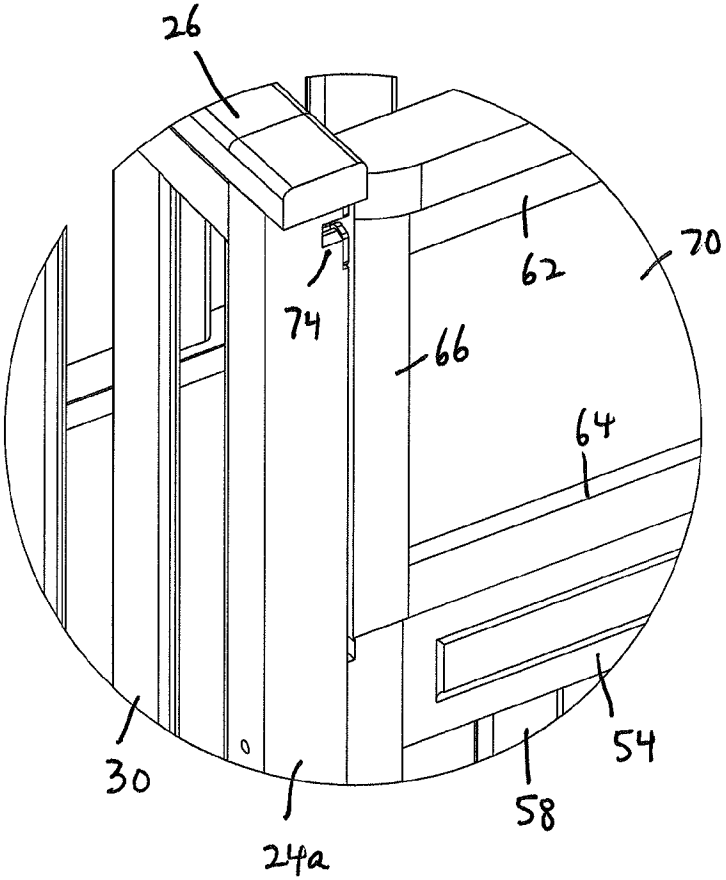
FIG. 12 is an enlarged perspective view of the crib of FIG. 11 at the upper end of one front corner post.
Figure 13:
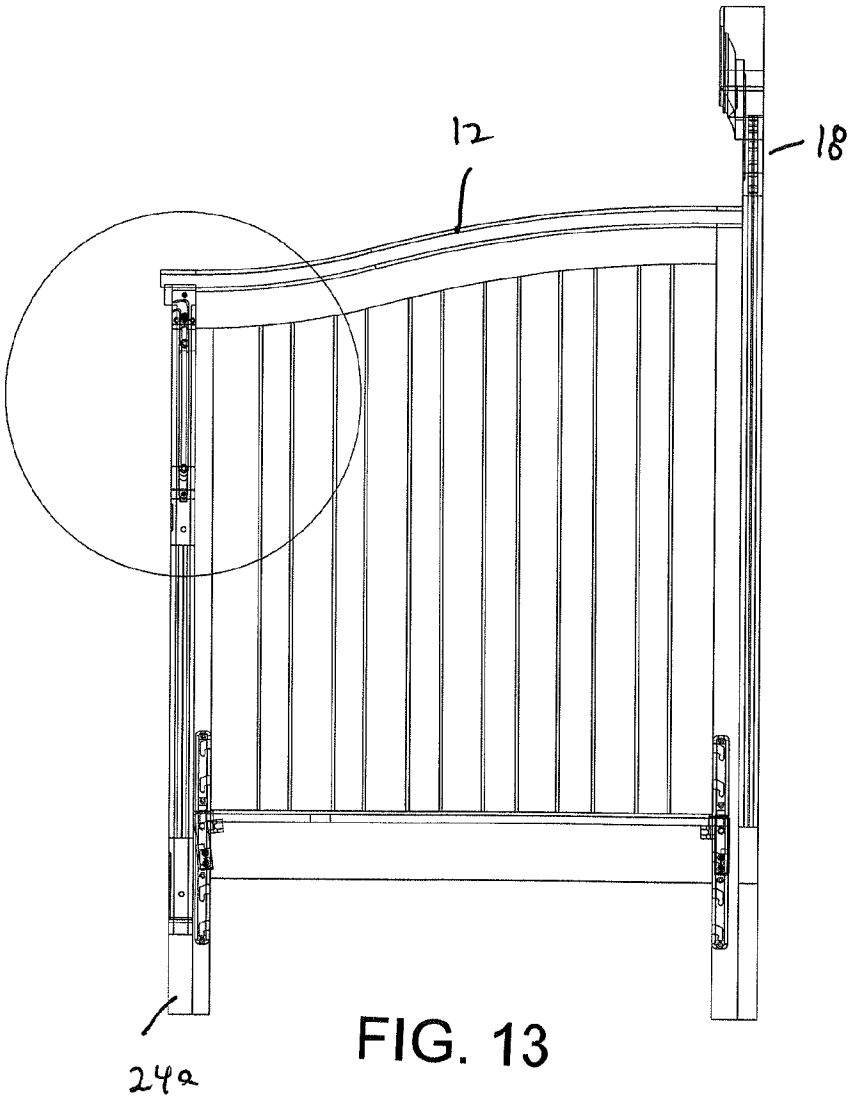
FIG. 13 is a cross-sectional view of the crib of FIG. 4, taken along line 13-13 thereof.
Figure 14:
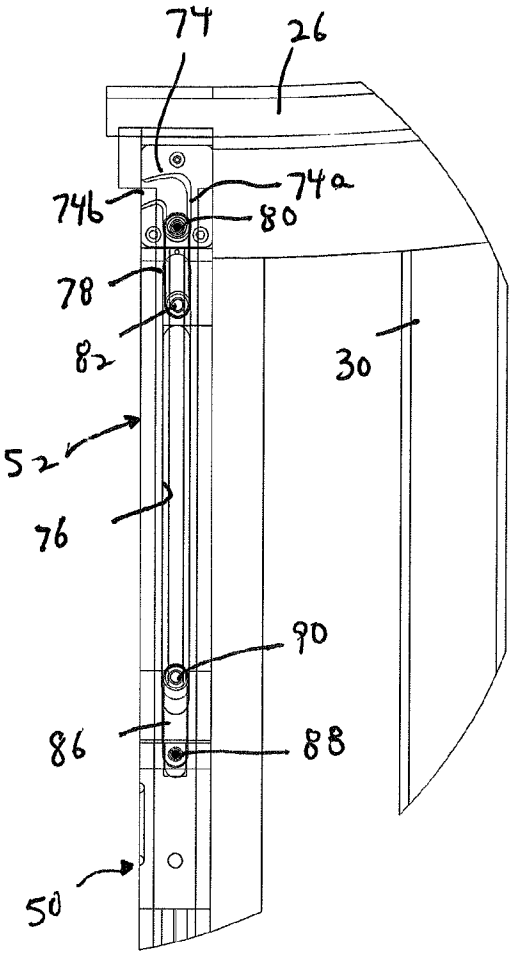
FIG. 14 is an enlarged cross-sectional view of the crib of FIG. 13 at the upper end of the front corner post.

As shown best in FIGS. 1, 2 and 5, stationary rail 18 includes an upper rail member 42 and a substantially parallel, spaced apart lower rail member 44 connected together by plurality of equidistantly spaced apart vertical slats or rods 46.

Stationary rail 18 can be secured to headboard 12 and footboard 14 in any suitable manner, such as screws or the like. Alternatively, stationary rail 18 is secured to headboard 12 in the manner disclosed in applicant's copending U.S. patent application Ser. No. 11/862,919, filed Sep. 27, 2007, the entire disclosure of which is incorporated herein by reference.

As best shown in FIGS. 1 and 2, partial drop side rail 20 includes a stationary or fixed lower rail section 50 and a slidable and pivotal upper rail section 52. Stationary lower rail section 50 includes a rectangular frame 51 comprised of an upper framing bar 54, a parallel, spaced apart lower framing bar 56 and side framing bars 55 and 57, with upper framing bar 54 and lower framing bar 56 connected together by a plurality of equidistantly spaced apart vertical slats or rods 58. Stationary lower rail section 50 is fixed to corner posts 24*a* and 34*a* by any suitable means, such as screws or the like.

Upper rail section 52 includes a rectangular frame 60 comprised of an upper framing bar 62, a parallel, spaced apart lower framing bar 64 and side framing bars 66 and 68 connected together in a rectangular configuration. Upper rail section 52 further includes a board 70 mounted to framing bars 62-68 in the opening of rectangular frame 60.

Referring now to FIGS. 11-30, the upper inner face of corner post 24*a* of headboard 12 which faces side framing bar 66 includes a vertical elongated guide, preferably in the form of a vertical elongated closed slot 72, in direct opposition to side framing bar 66 when upper rail section 52 is in its raised position. Immediately above slot 72 and not connected therewith is an L-shaped blind opening 74 which includes a vertical opening leg 74*a* that is closed at its lower end and that is in vertical alignment with slot 72 and a forwardly directed opening leg 74*b* that is in open communication with the upper end of vertical opening leg 74*a* and that extends forwardly and is open at the front face of corner post 24*a*. The inner face of corner post 34*a* of headboard 12 which faces side framing bar 68 also includes the same arrangement of a vertical elongated slot and L-shaped blind opening.

The outer face of side framing bar 66 which faces corner post 24*a* includes a vertical elongated guide, preferably in the form of a vertical elongated closed slot 76, immediately opposite vertical elongated closed slot 72. In like manner, the outer face of side framing bar 68 which faces corner post 34*a* includes a vertical elongated closed slot (not shown) immediately opposite the vertical elongated closed slot in corner post 34*a*.

An upper lever 78 is pivotally fixed at the outer face of side framing bar 66 by a pivot pin 80, and the opposite end of lever 78 includes a pin 82 that is captured in and slidably positioned in elongated slot 72 for movement therealong. Pin 80 extends outwardly of the outer face of side framing bar 66 to form a post 84, as shown best in FIGS. 22 and 26. The same arrangement of an upper lever arm (not shown) is provided at the opposite side of rectangular frame 60 between corner post 34*a* and side framing bar 68.

In the closed or raised position of upper rail section 52, post 84 fits within L-shaped blind opening 74. In this position, upper rail section 52 is positioned above and in vertical alignment in the same plane with stationary lower rail section 50.

A lower lever 86 is pivotally fixed by a pivot pin 88 to the inner face of corner post 24*a*, and the opposite end of lever 86 has a pin 90 slidably positioned in elongated slot 76 for movement therealong.

Figure 15:
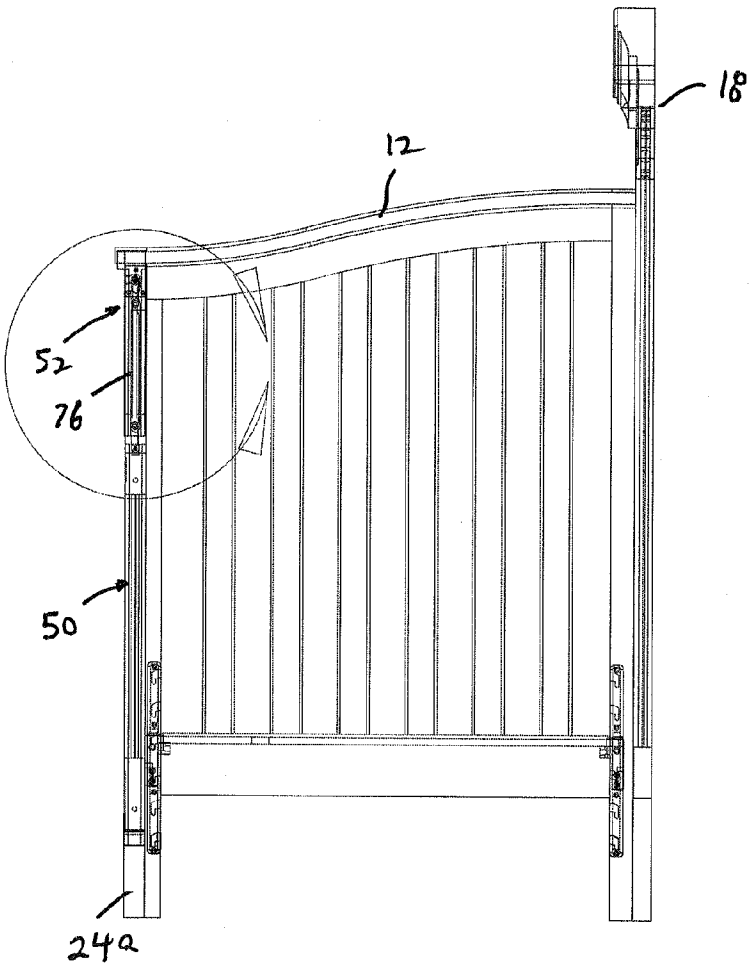
FIG. 15 is a cross-sectional view similar to FIG. 13, but with the upper rail section raised so that the post is at the upper end of the L-shaped blind opening, during lowering of the upper rail section.
Figure 16:
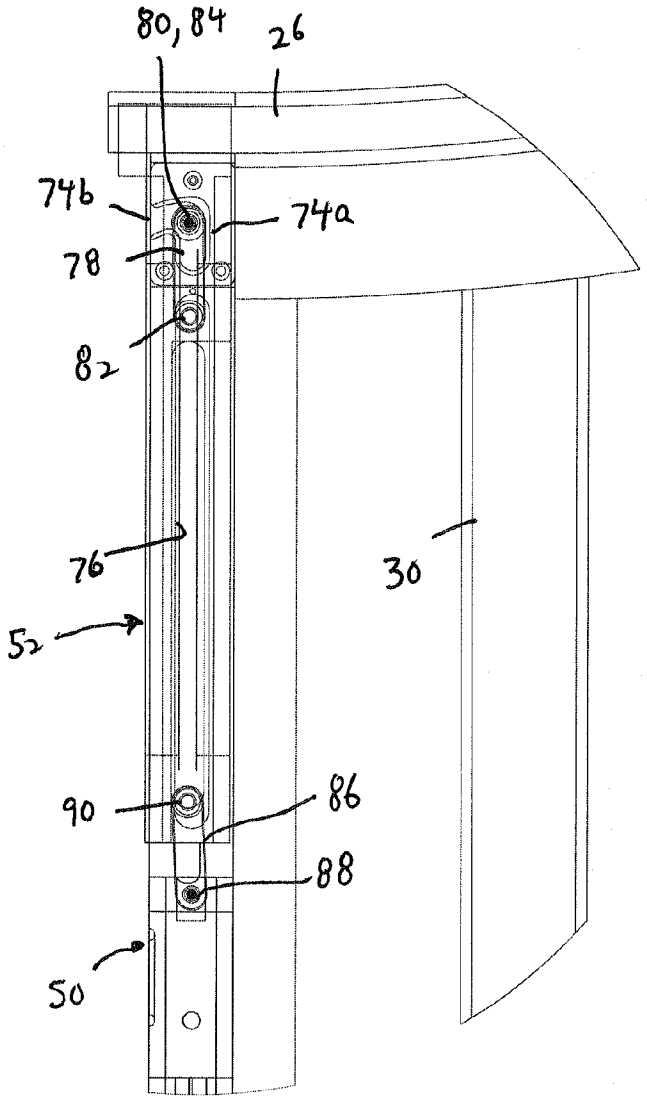
FIG. 16 is an enlarged cross-sectional view of the crib of FIG. 15 at the upper end of the front corner post.
Figure 17:
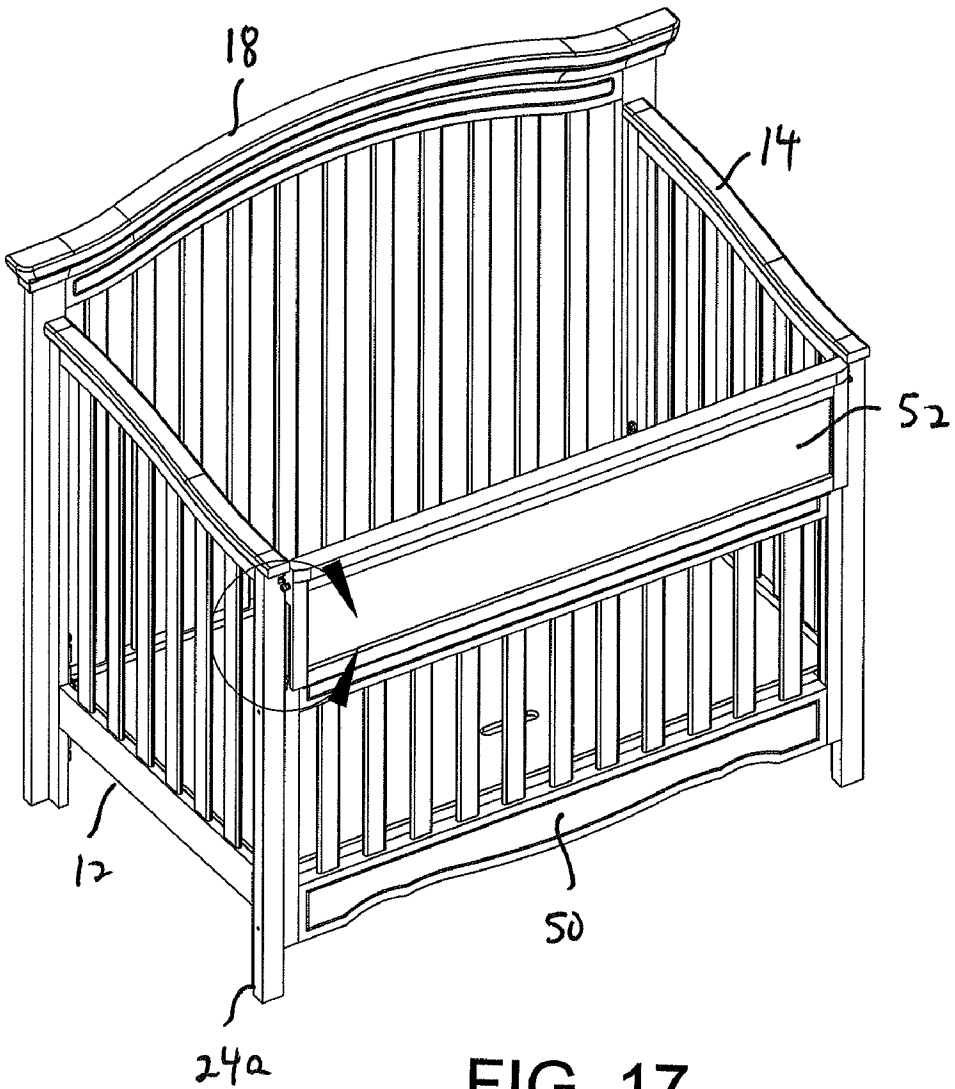
FIG. 17 is a front perspective view of the crib, with the upper rail section of the drop side rail in a raised position, but with the post at a position out of the L-shaped blind opening, during the next step of lowering of the upper rail section.
Figure 18:
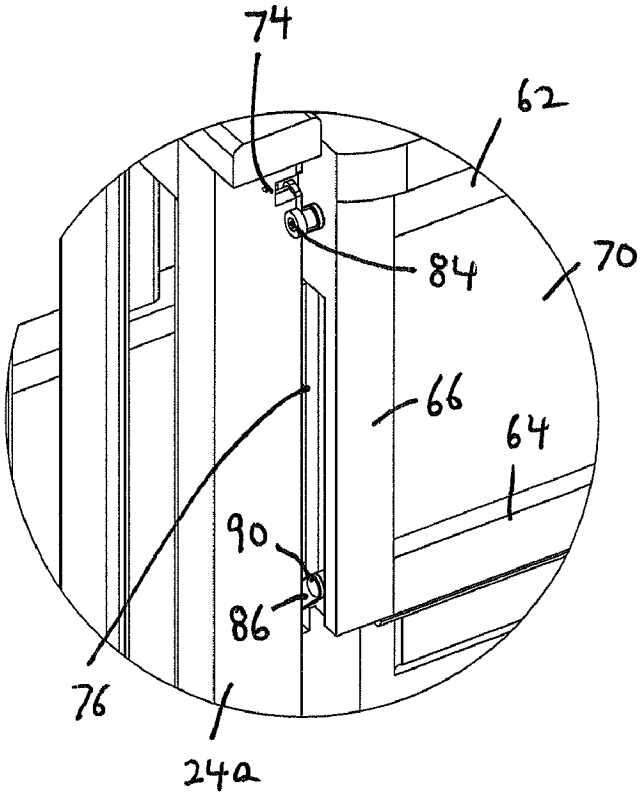
FIG. 18 is an enlarged perspective view of the crib of FIG. 17 at the upper end of one front corner post.
Figure 19:
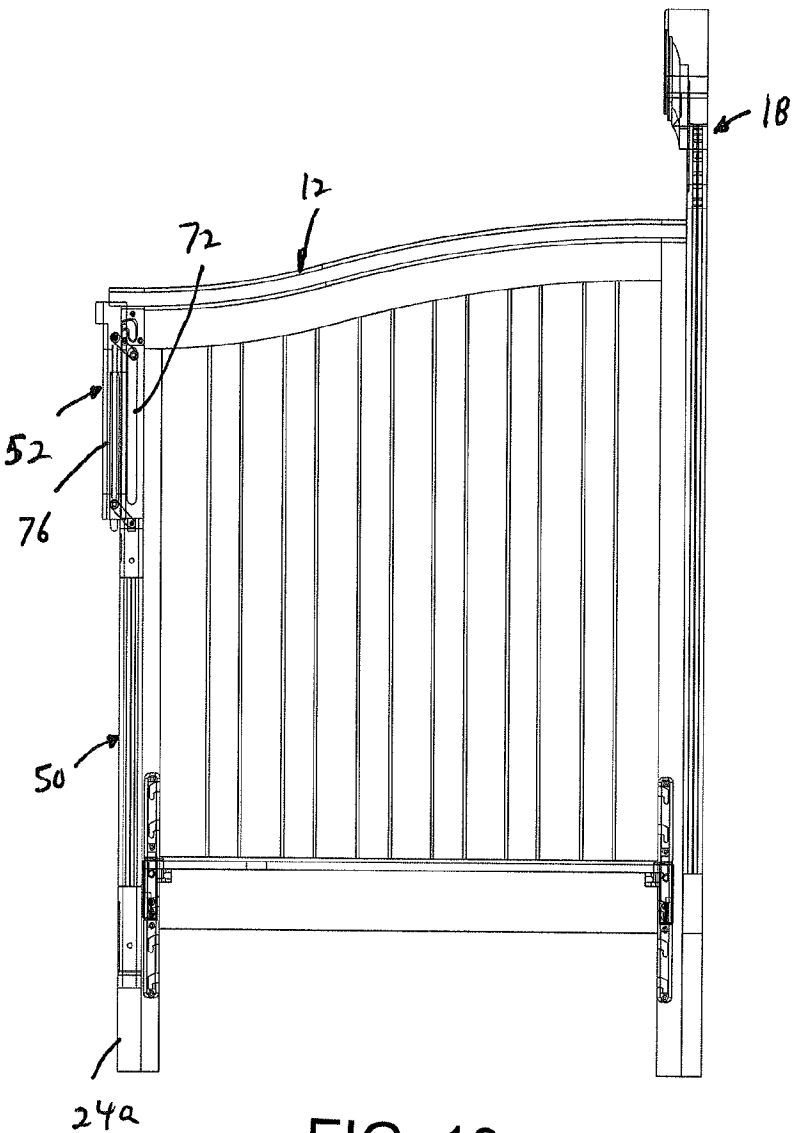
FIG. 19 is a cross-sectional view similar to FIG. 13, corresponding to the position of FIG. 17.
Figure 20:
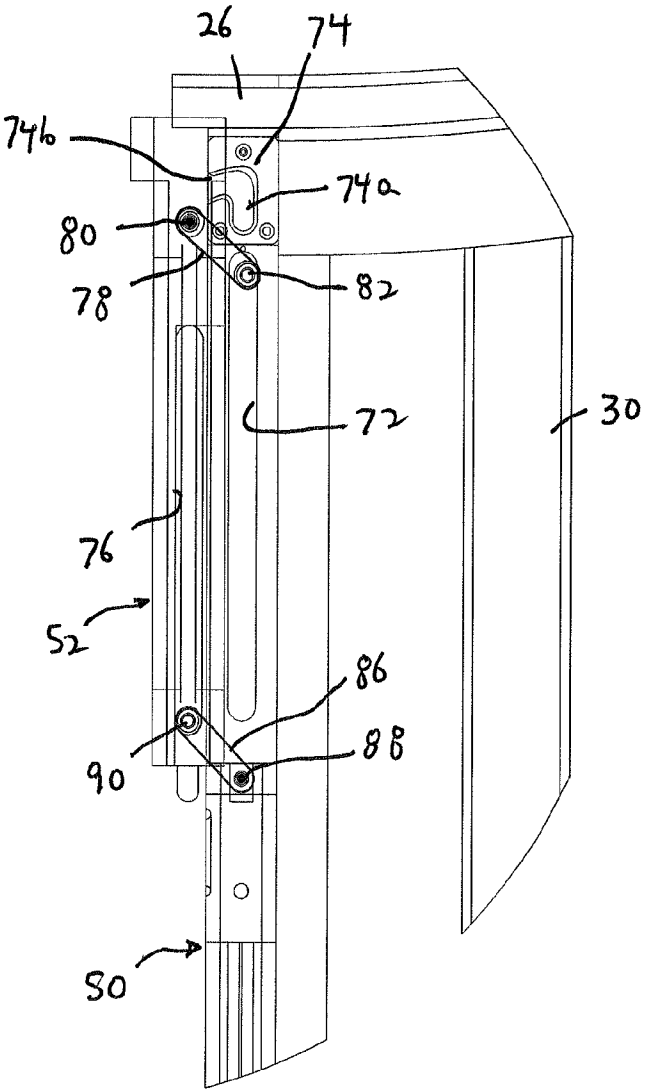
FIG. 20 is an enlarged cross-sectional view of the crib of FIG. 19 at the upper end of the front corner post.
Figure 21:
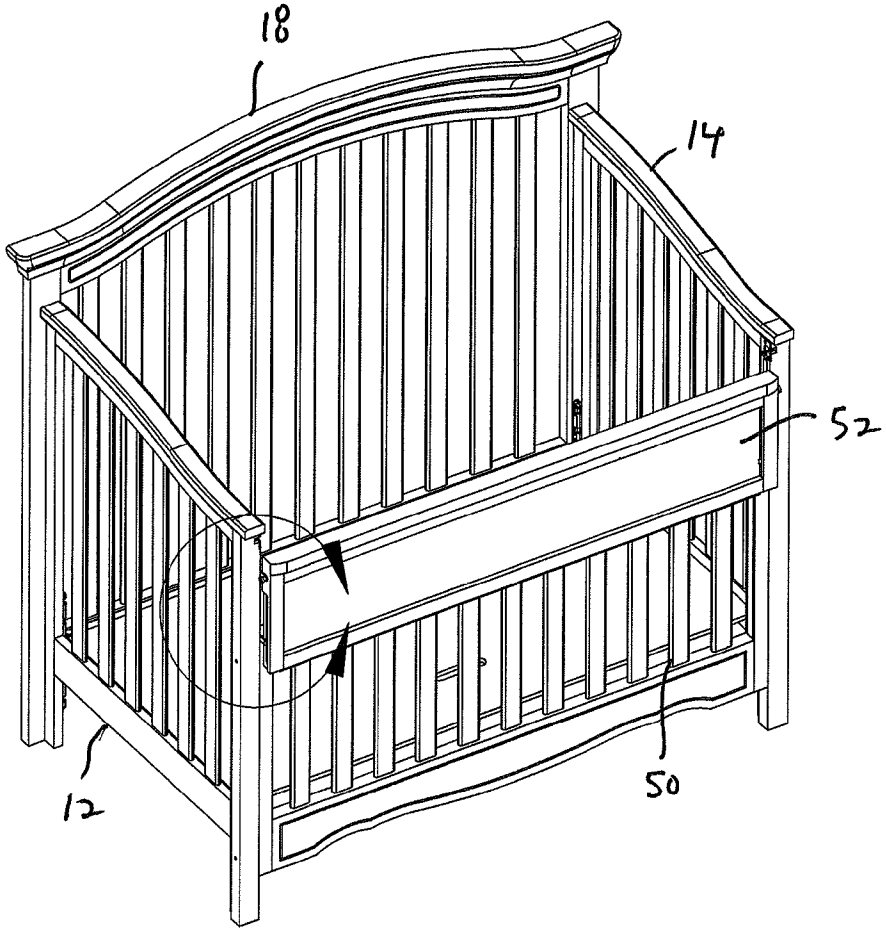
FIG. 21 is a front perspective view of the crib, with the upper rail section of the drop side rail in a slightly lowered position, during the next step of lowering of the upper rail section.
Figure 22:
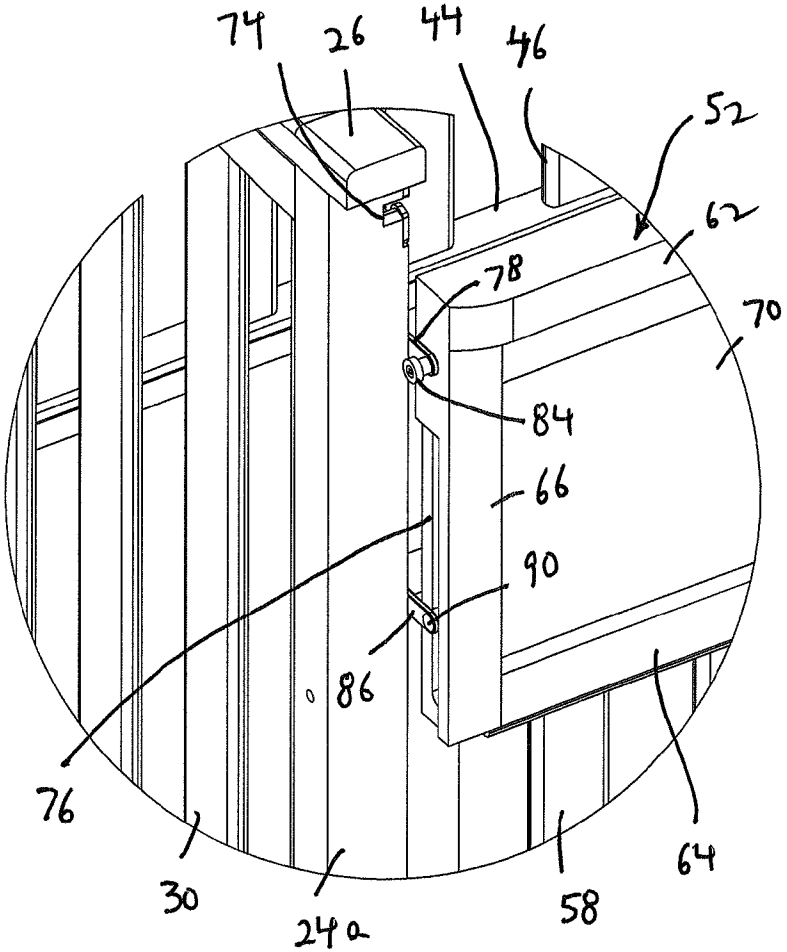
FIG. 22 is an enlarged perspective view of the crib of FIG. 21 at the upper end of one front corner post.
Figure 23:
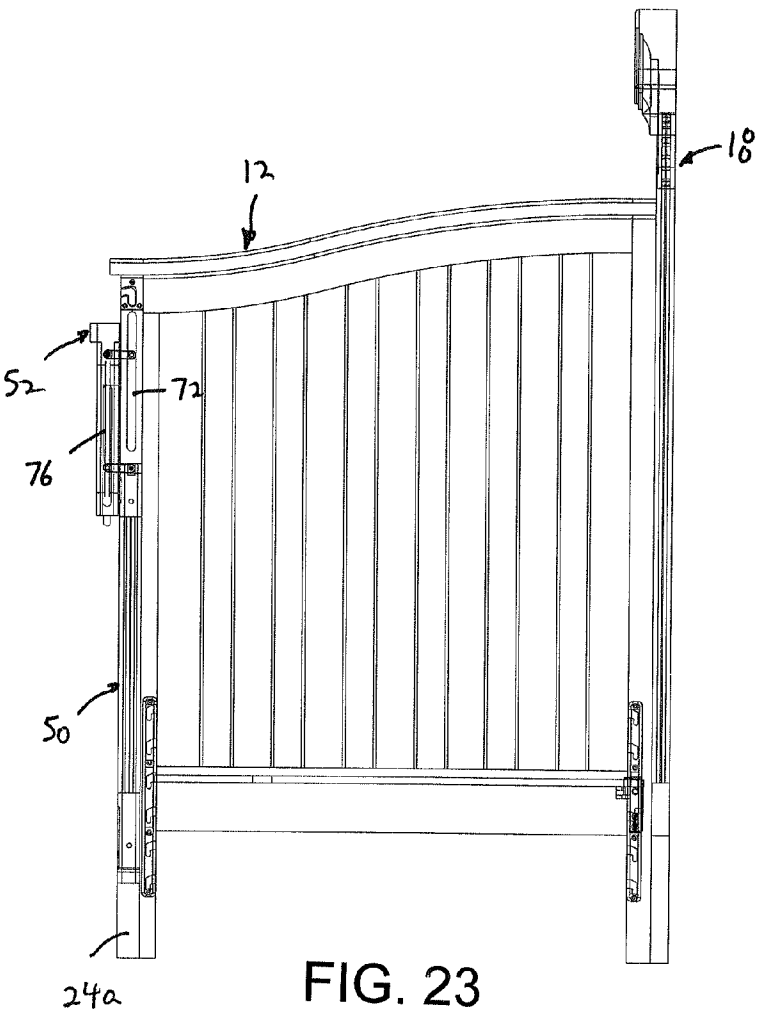
FIG. 23 is a cross-sectional view similar to FIG. 13, corresponding to the position of FIG. 21.
Figure 24:
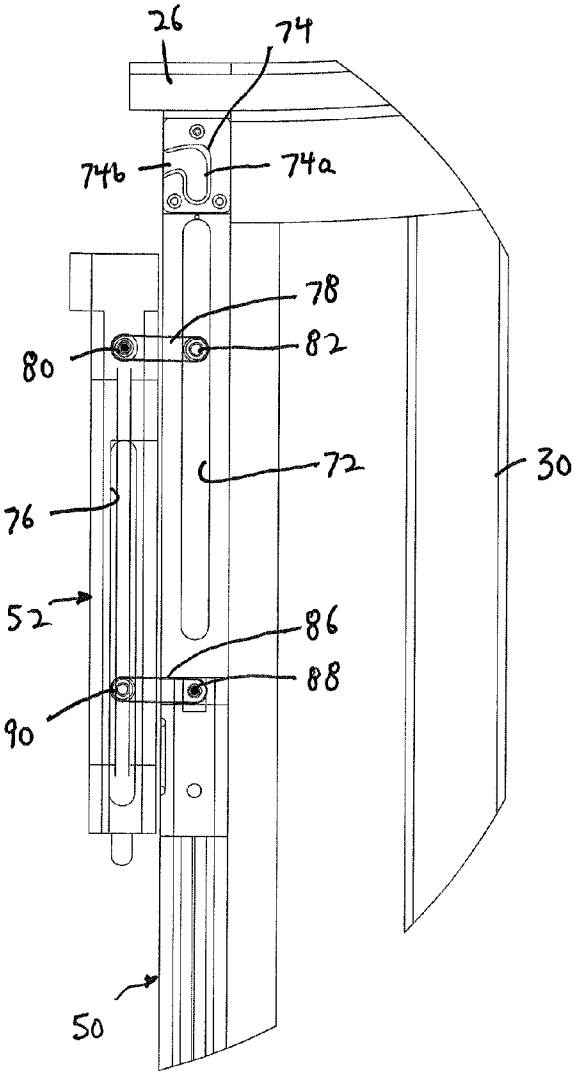
FIG. 24 is an enlarged cross-sectional view of the crib of FIG. 23 at the upper end of the front corner post.
Figure 25:
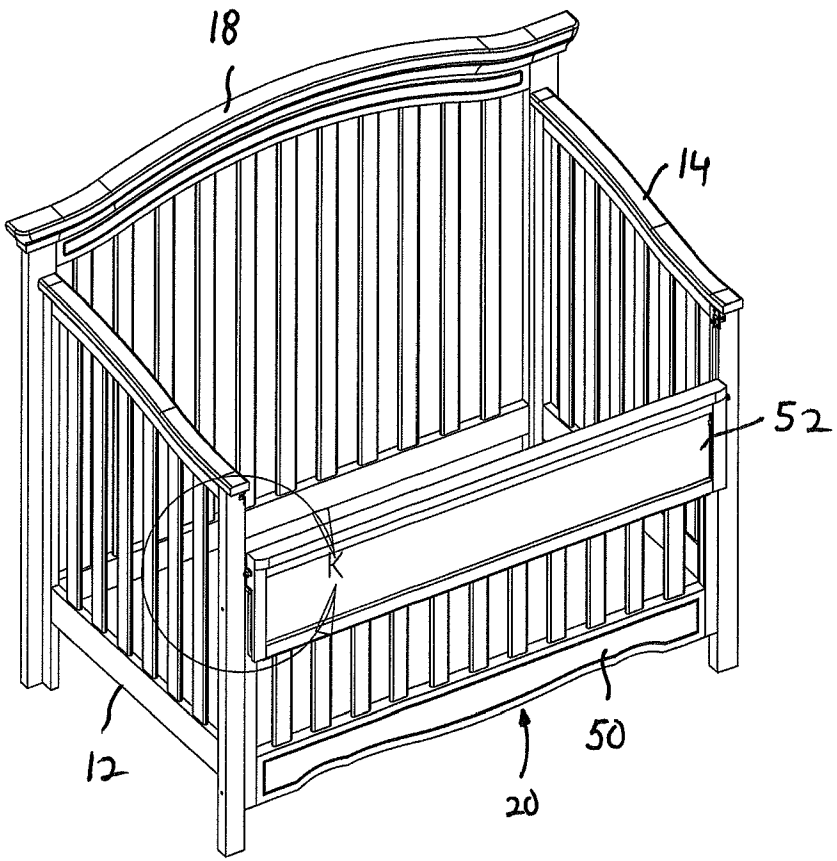
FIG. 25 is a front perspective view of the crib, with the upper rail section of the drop side rail in the fully lowered position.
Figure 26:
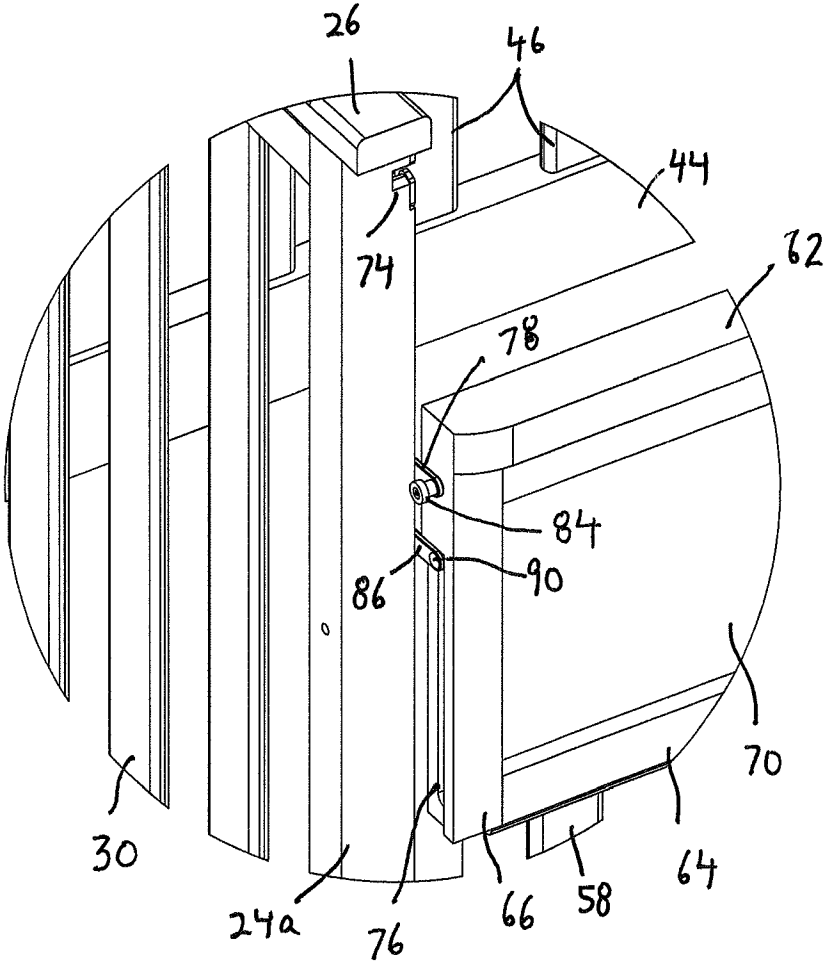
FIG. 26 is an enlarged perspective view of the crib of FIG. 25 at the upper end of one front corner post.
Figure 27:
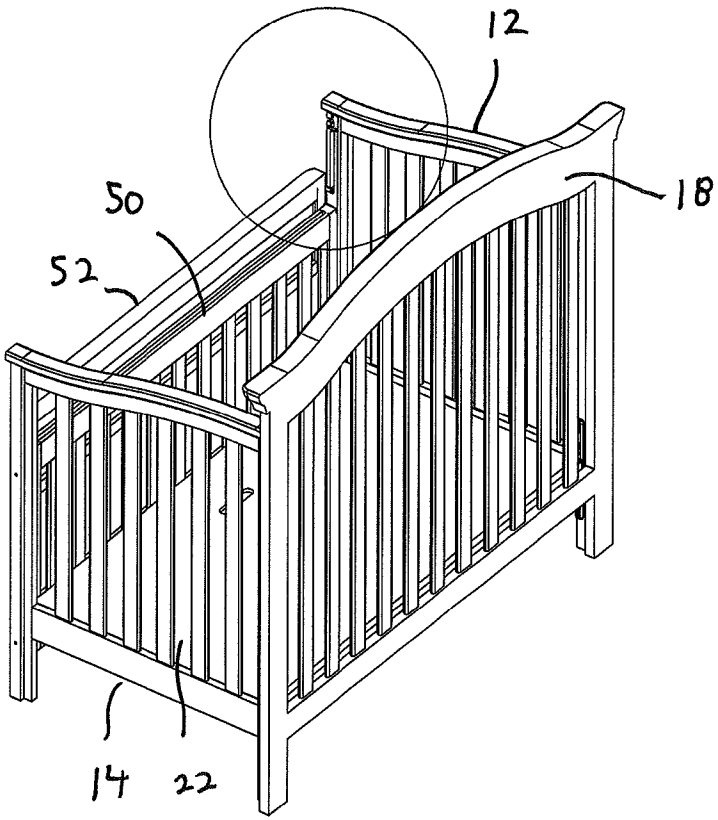
FIG. 27 is a rear perspective view of the crib, with the upper rail section of the drop side rail in the fully lowered position.
Figure 28:
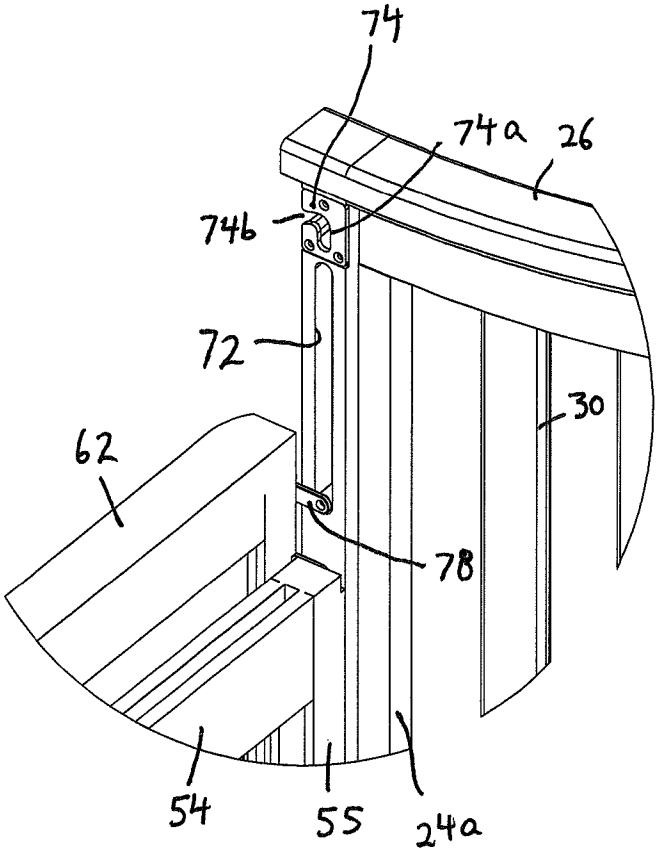
FIG. 28 is an enlarged perspective view of the crib of FIG. 27 at the upper end of one front corner post.
Figure 29:
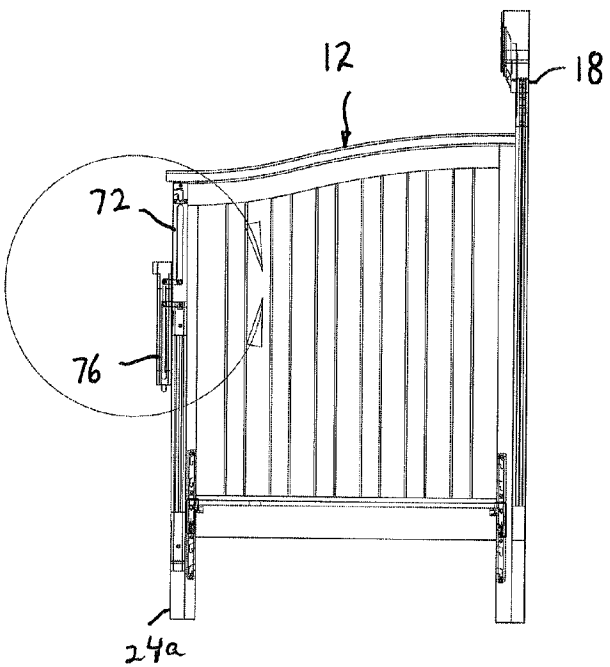
FIG. 29 is a cross-sectional view of the crib of FIG. 9, taken along line 29-29 thereof.
Figure 30:
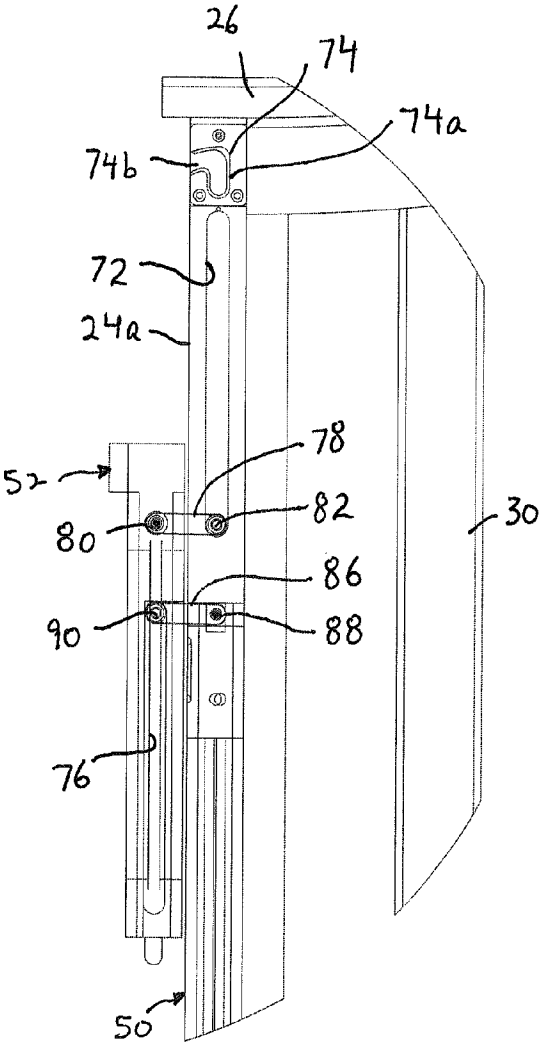
FIG. 30 is an enlarged cross-sectional view of a corner portion the crib of FIG. 29.

In order to lower upper rail section 52, upper rail section 52 is first raised upwardly so that post 84 rises within L-shaped blind opening 74, and specifically, rises up to the open end of vertical opening leg 74*a*, as shown in FIGS. 15 and 16, and then is moved forwardly where it escapes L-shaped blind opening 74 through forwardly directed opening leg 74*b*. Post 84 is then pulled outwardly away from the crib until post 84 escapes L-shaped blind opening 74, as shown in FIGS. 17-20. In this position, upper rail section 52 is no longer in vertical alignment with lower rail section 50, but rather, is positioned forwardly therefrom. Further, in this position, levers 78 and 86 are in parallel relation at an angle of about 45° to the vertical.

Thereafter, upper rail section 52 is lowered, whereby levers 78 and 86 assume a horizontal, spaced-apart position, as shown in FIGS. 21-24. During the lowering operation, pin 90 rides within elongated slot 76, and pin 82 rides within elongated slot 72. As such, lever 78 approaches lever 86, until upper rail section 52 is fully lowered, as shown best in FIGS. 25-30. In this position, upper rail section 52 is positioned in front of lower rail section 50 and superimposed thereon. The child can then be removed from or placed into the crib.

In order to raise upper rail section 52 to its closed position of FIG. 1, the reverse operation is performed such that upper rail section 52 is raised up until post 84 is inserted within L-shaped blind opening 74 in order to prevent accidental opening of the crib.

Thus, there is both a sliding and pivoting action of levers 78 and 86 that results in upper rail section 52 being moved between an upper closed position in which it is coplanar in vertical alignment with stationary lower rail section 50 and a lowered position in which it is positioned in front of stationary lower rail section 50 in parallel, spaced apart relation thereto.

In addition, although not shown, a separate latching or locking mechanism can be provided once upper rail section 52 is moved to the upper closed position, to prevent accidental opening by a child.

It will be appreciated that the present invention will operate with only elongated slot 72 and lever 78, and that elongated slot 76 and lever 86 merely provide extra guidance during movement of upper rail section 52.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A connecting arrangement for slidably securing a drop side rail of a crib to respective vertical posts of the headboard and footboard of the crib, said connecting arrangement comprising:

a first elongated guide in a vertical post of the headboard, a second elongated guide in a vertical post of the footboard, a first lever having one end pivotally mounted to the drop side rail and an opposite end slidably mounted with said first elongated guide, a second lever having one end pivotally mounted to the drop side rail and an opposite end slidably mounted with said second elongated guide, and a holding arrangement for releasably holding the drop side rail in an upper raised position.

2. A connecting arrangement according to claim 1, wherein said drop side rail includes:

a stationary lower side rail section fixedly mounted to respective vertical posts of the headboard and footboard of the crib, and an upper side rail section that is movable relative to the stationary lower side rail section, for movement between a raised position above and substantially coplanar with the lower side rail section and a lowered position in front of said lower side rail section, and wherein said one end of said first and second levers are pivotally mounted to the upper rail section of the drop side rail.

3. A connecting arrangement according to claim 1, further comprising:

a third elongated guide at one side of said drop side rail, a fourth elongated guide at an opposite side of said drop side rail, a third lever having one end pivotally mounted to the vertical post of the headboard and an opposite end slidably mounted with said third elongated guide, and a fourth lever having one end pivotally mounted to the vertical post of the footboard and an opposite end slidably mounted with said fourth elongated guide.

4. A connecting arrangement according to claim 3, wherein each elongated guide includes an elongated slot and the opposite end of each lever includes a pin slidably mounted in a respective said slot.

5. A connecting arrangement according to claim 3, wherein said first lever is vertically movable relative to said third lever, and said second lever is vertically movable relative to said fourth lever.

6. A connecting arrangement according to claim 3, wherein said first lever is positioned above said third lever, and said second lever is positioned above said fourth lever.

7. A connecting arrangement according to claim 3, wherein said one end of said first lever is pivotally mounted to the drop side rail at a position above said third elongated guide, and said one end of said second lever is pivotally mounted to the drop side rail at a position above said fourth elongated guide.

8. A connecting arrangement according to claim 3, wherein said one end of said third lever is pivotally mounted to the vertical post of the headboard at a position below said first elongated guide, and said one end of said fourth lever is pivotally mounted to the vertical post of the footboard at a position below said second elongated guide.

9. A connecting arrangement according to claim 1, wherein said holding arrangement includes a blind opening in the vertical post of at least one of the headboard and the footboard, and a post secured to the opposite end of at least one of the first and second levers for engaging in said blind opening in the vertical post of said at least one of the headboard and the footboard, to releasably hold the drop side rail in an upper raised position.

10. A crib comprising:

a headboard having a pair of spaced apart vertical posts;

a footboard having a pair of spaced apart vertical posts;

a mattress support for supporting a mattress between the headboard and footboard;

a first side rail secured to respective vertical posts of the headboard and footboard on one side of the crib;

a drop side rail; and a connecting arrangement for slidably securing the drop side rail to respective vertical posts of the headboard and footboard on an opposite side of the crib, said connecting arrangement including:

a first elongated guide in a vertical post of the headboard, a second elongated guide in a vertical post of the footboard, a first lever having one end pivotally mounted to the drop side rail and an opposite end slidably mounted with said first elongated guide, a second lever having one end pivotally mounted to the drop side rail and an opposite end slidably mounted with said second elongated guide, and a holding arrangement for releasably holding the drop side rail in an upper raised position.

11. A crib according to claim 10, wherein said drop side rail includes:

a stationary lower side rail section fixedly mounted to respective vertical posts of the headboard and footboard of the crib, and an upper side rail section that is movable relative to the stationary lower side rail section, for movement between a raised position above and substantially coplanar with the lower side rail section and a lowered position in front of said lower side rail section, and wherein said one end of said first and second levers are pivotally mounted to the upper rail section of the drop side rail.

12. A crib according to claim 10, further comprising:

a third elongated guide at one side of said drop side rail, a fourth elongated guide at an opposite side of said drop side rail, a third lever having one end pivotally mounted to the vertical post of the headboard and an opposite end slidably mounted with said third elongated guide, and a fourth lever having one end pivotally mounted to the vertical post of the footboard and an opposite end slidably mounted with said fourth elongated guide.

13. A crib according to claim 12, wherein each elongated guide includes an elongated slot and the opposite end of each lever includes a pin slidably mounted in a respective said slot.

14. A crib according to claim 12, wherein said first lever is vertically movable relative to said third lever, and said second lever is vertically movable relative to said fourth lever.

15. A crib according to claim 12, wherein said first lever is positioned above said third lever, and said second lever is positioned above said fourth lever.

16. A crib according to claim 12, wherein said one end of said first lever is pivotally mounted to the drop side rail at a position above said third elongated guide, and said one end of said second lever is pivotally mounted to the drop side rail at a position above said fourth elongated guide.

17. A crib according to claim 12, wherein said one end of said third lever is pivotally mounted to the vertical post of the headboard at a position below said first elongated guide, and said one end of said fourth lever is pivotally mounted to the vertical post of the footboard at a position below said second elongated guide.

18. A crib according to claim 10, wherein said holding arrangement includes a blind opening in the vertical post of at least one of the headboard and the footboard, and a post secured to the opposite end of at least one of the first and second levers for engaging in said blind opening in the vertical post of said at least one of the headboard and the footboard, to releasably hold the drop side rail in an upper raised position.

* * * * *